US007830264B2

(12) United States Patent
Tetiyevsky

(10) Patent No.: US 7,830,264 B2
(45) Date of Patent: Nov. 9, 2010

(54) REMOVABLE ELECTRONIC TAG HOUSING ASSEMBLY

(75) Inventor: Alex Tetiyevsky, Springfield, NJ (US)

(73) Assignee: B&G International, Inc., Newark, NJ (US)

( * ) Notice: Subject to any disclaimer, the term of this patent is extended or adjusted under 35 U.S.C. 154(b) by 270 days.

(21) Appl. No.: 11/998,363

(22) Filed: Nov. 29, 2007

(65) Prior Publication Data

US 2008/0122633 A1 May 29, 2008

Related U.S. Application Data

(60) Provisional application No. 60/861,640, filed on Nov. 29, 2006.

(51) Int. Cl.
*G08B 13/14* (2006.01)

(52) U.S. Cl. ..... 340/572.8; 340/693.1; 340/568.1; 340/571; 24/704.1

(58) Field of Classification Search ... 340/572.1–572.9, 340/693.5, 568.1, 571; 70/57.1; 24/704.1
See application file for complete search history.

(56) References Cited

U.S. PATENT DOCUMENTS

| | | | | |
|---|---|---|---|---|
| 1,339,238 | A | 5/1920 | Tillman | |
| 2,149,087 | A | 2/1939 | Fisher | |
| 2,512,082 | A | 6/1950 | Bainbridge et al. | |
| 4,133,133 | A | 1/1979 | Casset | |
| 4,136,478 | A | 1/1979 | Wycosky | |
| 4,237,640 | A | 12/1980 | Sato | |
| 4,359,161 | A | 11/1982 | Sinoff | |
| 4,493,416 | A | 1/1985 | Steinman | |
| 4,726,139 | A | 2/1988 | Tokuda | |
| 4,795,197 | A | 1/1989 | Kaminski et al. | |
| 4,850,130 | A | 7/1989 | Childre et al. | |
| 4,946,034 | A | 8/1990 | Matsubara | |
| 5,222,319 | A | 6/1993 | Yamato | |
| 5,347,742 | A | 9/1994 | Ohmura | |
| 5,361,611 | A | 11/1994 | Hisler | |
| 5,385,373 | A | 1/1995 | Love | |
| 5,873,144 | A | 2/1999 | Tupper et al. | |
| 6,067,740 | A | 5/2000 | Alley | |
| 6,151,826 | A | 11/2000 | Grice | |
| 6,317,046 | B1 | 11/2001 | Fresnel et al. | |
| 6,374,534 | B1 | 4/2002 | Takizawa | |
| 6,433,686 | B1 | 8/2002 | Feibelman | |
| 6,629,382 | B2 | 10/2003 | Irrgang et al. | |
| 6,694,666 | B2 | 2/2004 | Iwabuchi | |
| 6,774,794 | B2 | 8/2004 | Zimmerman et al. | |
| 2005/0128089 | A1 | 6/2005 | Feibelman | |
| 2006/0021394 | A1 * | 2/2006 | Belden | 70/57.1 |
| 2006/0174667 | A1 | 8/2006 | Gerner | |
| 2007/0080811 | A1 * | 4/2007 | Venderley et al. | 340/572.8 |

* cited by examiner

*Primary Examiner*—George A Bugg
*Assistant Examiner*—Hongmin Fan
(74) *Attorney, Agent, or Firm*—Hoffman & Baron, LLP

(57) ABSTRACT

The present invention provides a removable electronic tag housing. The housing includes a base for supporting the electronic tag. A cover is removably attachable to the base and defines between the cover and the base a passageway for accommodating an elongate member. The base includes a deflectable latch for locking engagement with the cover. The cover includes an access opening adjacent the latch for insertion of a removal tool thereinto to release the latch permitting detachment of the cover from the base.

18 Claims, 4 Drawing Sheets

REMOVABLE ELECTRONIC TAG HOUSING ASSEMBLY

CROSS-REFERENCE TO RELATED APPLICATION

This application claims priority to U.S. Provisional Patent Application No. 60/861,640 filed on Nov. 29, 2006.

FIELD OF THE INVENTION

The present invention relates generally to a housing assembly for supporting electronic tags to an article. More particularly, the present invention relates to an electronic tag housing assembly which may be removed from the article at point of purchase.

BACKGROUND OF THE INVENTION

Electronic tags are used for a wide variety of purposes including the tracking of items which contain the tag, inventory control, security, and also provide information which may be electronically readable. These tags or markers may include radio frequency identification (RFID) tags or electronic article surveillance (EAS) tags. EAS tags may be used to provide theft deterrence. These tags are used in combination with an alarm system which monitors undesired movement of the article containing the EAS tags.

Housings have been developed which accommodate the electronic tag and which attach the tags to the desired article. Clearly, especially in the case of electronic article surveillance tags to deter theft, it is necessary that the tag be securely supported to the article in such a manner where it remains with the article until time of purchase.

There are currently available a number of tag housings which secure the tag to the article in the manner which thwarts unauthorized removal of the tag from the housing. However, many of these tags have become difficult to remove even by authorized personnel. It can be appreciated that in order for the purchaser to leave with the article the electronic tag must be removed or deactivated.

The art has seen a wide variety of apparatuses used to remove the electronic tag in an authorized manner. However, many of these devices are cumbersome, difficult to use and costly.

It is desirable to provide an electronic tag housing assembly which may be securely placed on an article to prevent easy unauthorized removal, but may be removed at point of purchase by authorized personnel.

SUMMARY OF THE INVENTION

The present invention provides a removable electronic tag housing. The housing includes a base for supporting the electronic tag. The tag may preferably be an electronic article surveillance (EAS) tag or a radio frequency identification (RFID) tag. A cover is removably attachable to the base and defines between the cover and the base a passageway for accommodating an elongate member. The base includes a deflectable latch for locking engagement with the cover. The cover includes an access opening adjacent the latch for insertion of a removal tool thereinto to release the latch permitting detachment of the cover from the base.

In a preferred embodiment the base and the cover of the housing supports an elastomeric pad for resilient engagement with an elongate member. The present invention also provides an assembly for removably securing an electronic tag to an elongate article. The assembly includes a tag housing for supporting the electronic tag. The tag housing includes a base and a cover defining therebetween a passageway for the elongate article. The based includes a deflectable latch and the cover includes a catch for releasable engagement with the latch. The cover also includes an opening adjacent the catch. The assembly further includes a removal tool having a body and insertion member. The insertion member is insertably received in the opening to engage the latch of the base to deflect the latch from removable engagement with the catch thereby releasing the cover from base permitting removal of the tag housing from the elongate article.

One embodiment of the present invention includes a removable electronic tag housing including a base and a cover. The base supports an electronic tag. The base includes opposing sidewalls extending from a top surface of the base and a series of spaced apart ribs extending from a top surface of the base. The series of ribs extend between the opposing sidewalls. The series of ribs define a half pipe geometry to support and elongated object thereon. The opposing sidewalls includes slots therethrough and the base includes deflectable latches extending from the top surface of the base opposed the slots. The base includes a bottom panel attached to a bottom surface of the base and an upper panel covering the upper surface of the base. The upper panel includes an open top portion to allow the series of ribs to remain uncovered by the upper panel. The cover is removably attachable to the base defining an passageway for accommodating an elongate member therebetween. The cover has a semi circular shape and access openings extending on either side of the cover. The access openings include catches to engage with the latches of the base.

DETAILED DESCRIPTION OF THE PREFERRED EMBODIMENTS

Figure 1:
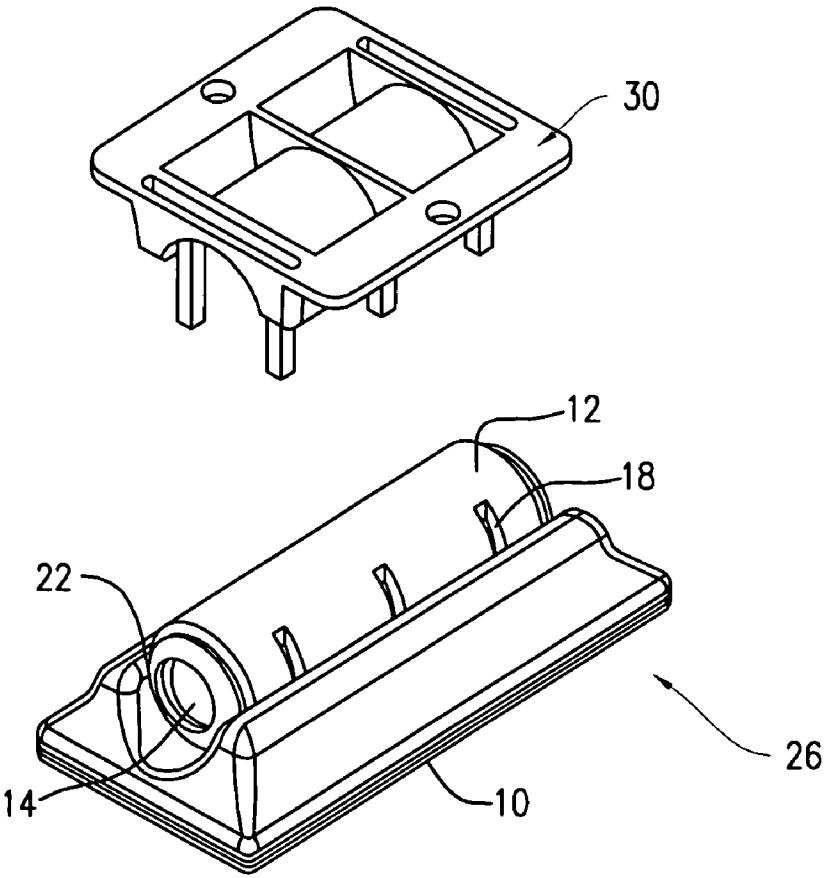
FIG. 1 is a perspective showing of the removal electronic tag housing assembly of the present invention including the removal tool.

Referring to FIG. 1 of the present invention, there is shown a removable electronic tag housing 26. The housing 26 includes a base 10 and cover 12. The base 10 is for supporting an electronic tag 24. The base 10 and cover 12 are removably engageable using a latching system 50. The base 10 and cover 12 define a passageway 14 for accommodating an elongated member therethrough.

Figure 3:
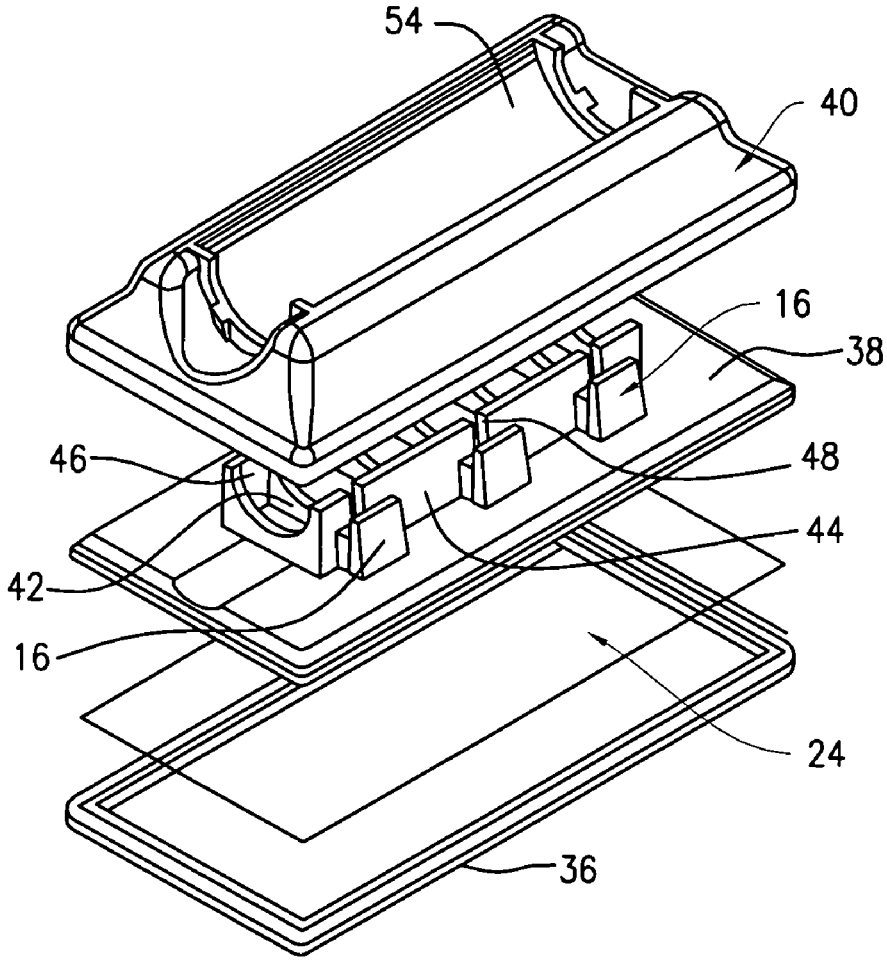
FIG. 3 shows the case of the electronic tag housing assembly of FIG. 1 in an exploded perspective view.
Figure 4:
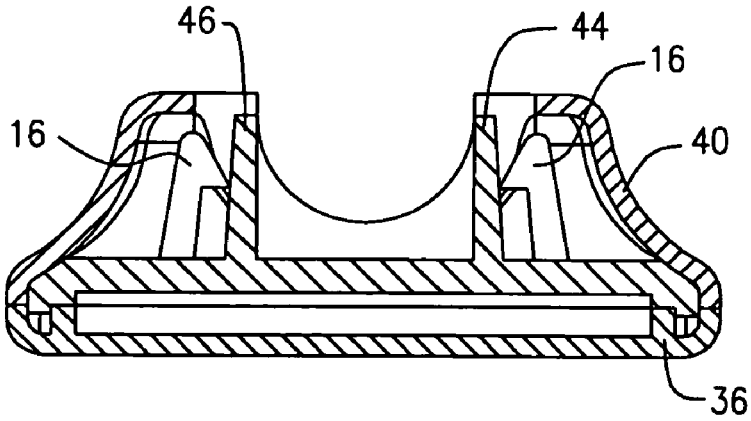
FIG. 4 is a cross sectional showing of the base of FIG. 3.

FIGS. 3 and 4 show base 10 including a bottom panel 36, main base component 38, and an upper panel 40. A tag 24 is placed between the bottom panel 36 and main base component 38. The upper panel 40 is placed over the main base component 38 to protect the mechanisms of the main base component 38. The upper panel 40 is attached to the bottom panel 36 leaving the main base component 38 sandwiched therebetween.

The main base component 38 includes a series of spaced apart ribs 42 forming a half pipe shape to support the elongate object which will be placed thereacross. The series of ribs 42 extend between two side walls 44 and 46. The side walls 44 and 46 include slots 48. The main base component 38 also includes a plurality of deflectable latches 16 which are located exterior to the side walls 44 and 46 and adjacent the slots 48.

The upper panel 40 is a molded piece to cover a portion of the main base component 38. The upper panel 40 has an open top portion 54 which exposes the series of ribs 42 of the main base 38. The upper panel 40 is attached to the bottom panel 26 enclosing the main base component 38 therein.

Additionally, an elastomeric pad 22 may be added to the base 10. The elastomeric pad 22; which may be of TPE, santoprene or material having a Shore hardness value between about 30 and 60; is placed in the open top portion 54 of the upper panel 40, and secured over the main base component 38 to cover the series of ribs 42. The ribs 42 provide structural support while the elastomeric pad 22 provides resilient engagement with an elongated member.

Figure 2:
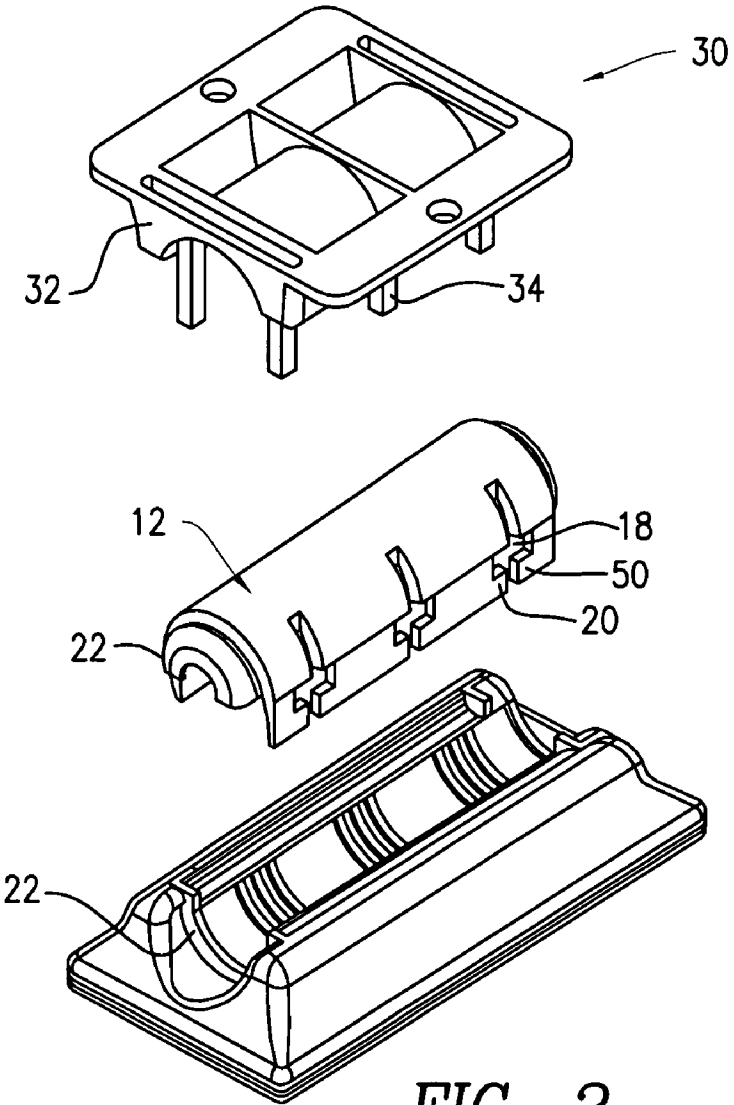
FIG. 2 shows the electronic tag housing assembly of FIG. 1 in an exploded perspective view.
Figure 8:
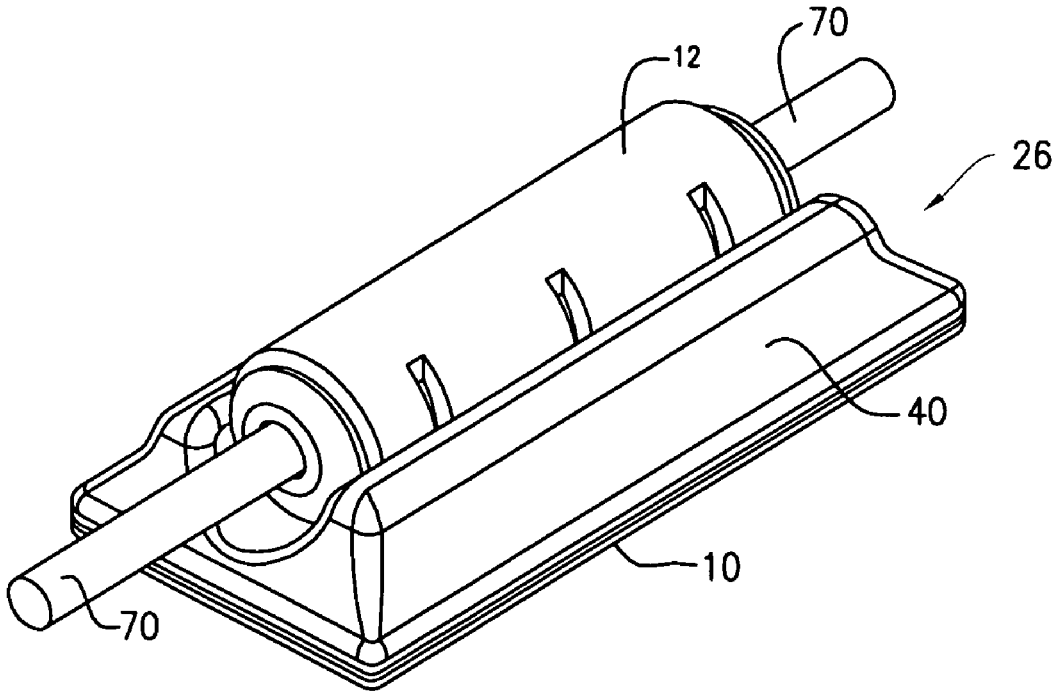
FIG. 8 is a perspective view of the electronic tag housing assembly of FIG. 1 including an elongated object therein.

FIGS. 1, 2 and 8 show cover 12 having a semi-circular shape portion such that when the base 10 and cover 12 are joined together, a generally cylindrical passageway 14 is defined therebetween. An elongated article (not shown) may be positioned through the passageway 14, i.e., the base 10 and cover 12 wrap about and removably secured around the elongated article. The cover 12 includes access opening 18 which align with the latch 16 of base 10 when the cover 12 is secured to base 10. The cover 12 includes plural catches 20 for releaseable engagement with the latch 16 of base 10. Each catch 20 is in alignment with the access opening 18. The cover 12 may also include an elastomeric pad 23 to provide protection between the cover 12 and elongated object and to provide for secure engagement.

Figure 7:
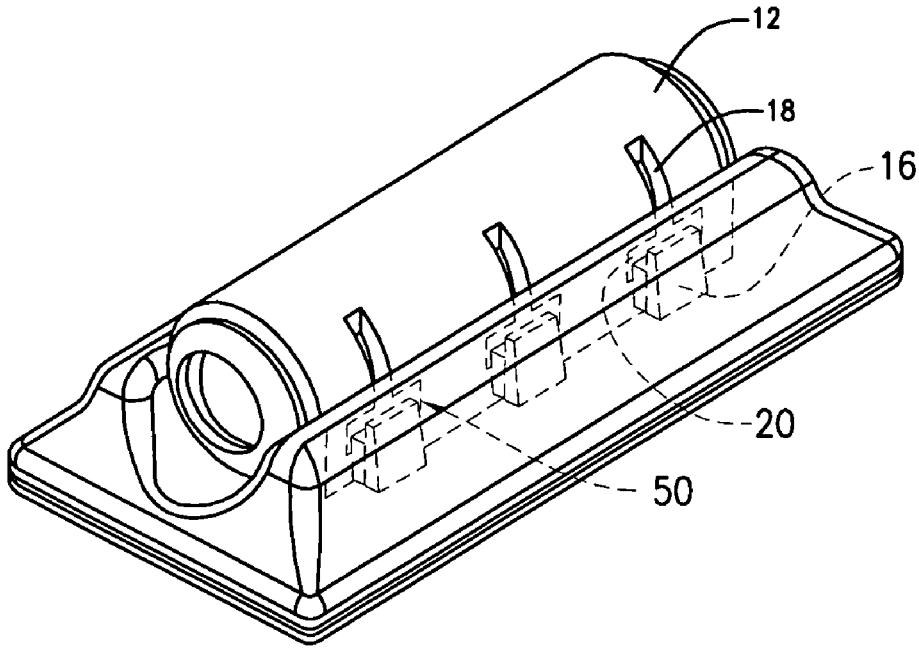
FIG. 7 is a perspective view of the electronic tag housing assembly of FIG. 1 showing the latching system between the cover and base.

FIG. 7 shows the cover 12 is removably secured to base 10 using latching assembly 50. The latching assembly 50 including latch 16 of base 10 and catch 20 of cover 12. The cover 12 is placed over the base 10 and the latch 16 engages with the catch 20 to secure the cover 12 to the base 10. Once the latch 16 engages with catch 20, the cover is not removable unless tool 30 is used to disengage the latch 16 with catch 20.

Figure 5:
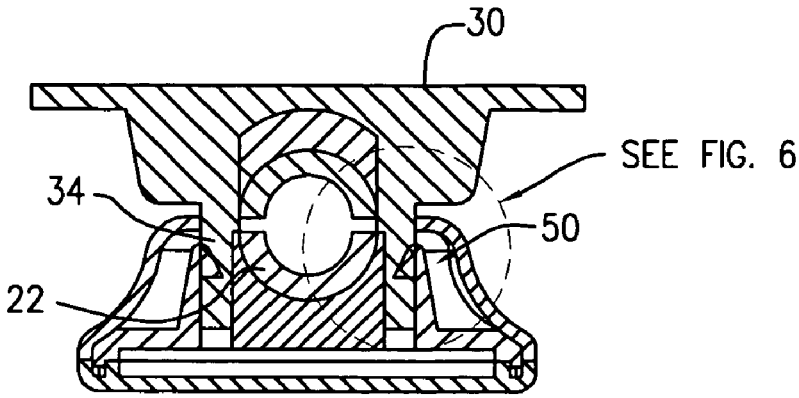
FIG. 5 is a cross sectional view of the assembled tag housing assembly of the present invention including the removal tool inserted therein.
Figure 6:
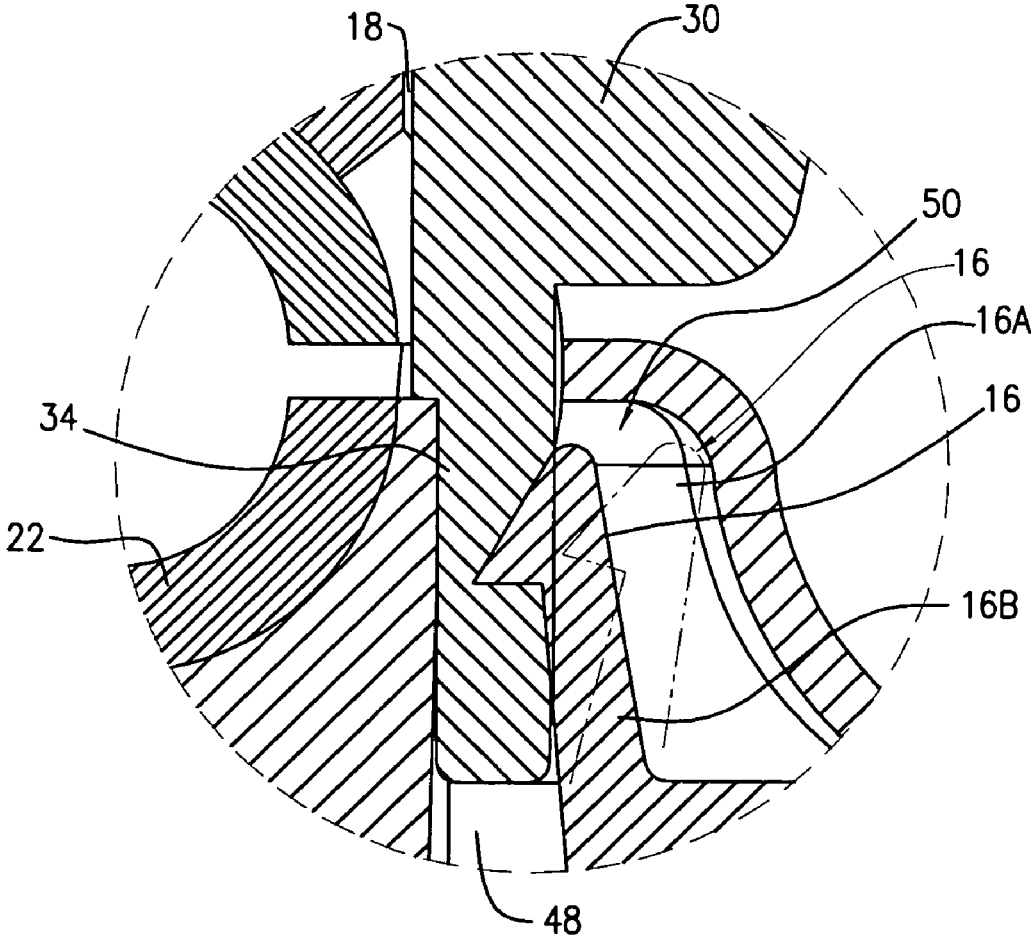
FIG. 6 is an enlarged sectional showing of the assembly of FIG. 5.

FIGS. 5 and 6 show tool 30 for effective removal of the cover 12 from the base 10 to remove the housing 26 from the elongated object. Tool 30 includes a body and depending insertion members 34. Tool 30 is placed over cover 12 and insertion members 34 extend through access opening 18 of the cover 12. The insertion members 34 further extend through slots 48 of the base 10. The insertion members 34 contact latch 16 as it is being depressed through the slots 48. The insertion member 34 is guided down the head 16*a* of the latch 16 and deflect the base 16*b* of the latch 16 outward away from the insertion member 34. As latch 16 is deflected it becomes disengaged from catch 20 and the cover 12 is easily removable from the base 10.

Having described particular arrangements of the present invention herein, it should be appreciated by those skilled in the art that modifications may be made thereto without departing from the contemplated scope thereof Accordingly, the arrangements described herein are intended to be illustrative rather than limiting, the true scope of the invention being set forth in the claims appended hereto.

What is claimed is:

1. A removable electronic tag housing comprising:

a base for supporting an electronic tag, said base including a top surface and opposing side walls extending from said top surface;

a cover removably attachable to said base and defining therebetween a passageway for accommodating an elongate member;

said base including a deflectable latch extending from said top surface for locking engagement with said cover;

said cover including an access opening adjacent said latch for insertion of a removal tool thereinto to release said latch permitting detachment of said cover from said base, wherein said base further includes an upper panel covering said top surface of said base, said upper panel including an open top portion to allow a portion of said top surface defined by said passageway to remain uncovered by said upper panel.

2. An electronic tag housing of claim 1 wherein said base includes a plurality of said deflectable latches and said cover includes a plurality of deflectable catches for releasably mating with said plurality of latches.

3. An electronic tag housing of claim 1 wherein said base supports an elastomeric pad for resilient engagement with said elongate member.

4. An electronic tag housing of claim 1 wherein said cover supports an elastomeric pad for resilient engagement with said elongate member.

5. An electronic tag housing of claim 1 wherein said base includes a series of spaced apart ribs extending from a top surface of said base.

6. An electronic tag housing of claim 5 wherein each of said series of ribs extend between opposing sidewalls.

7. An electronic tag housing of claim 6 wherein said opposing sidewalls includes at least one slot therethrough.

8. A removable electronic tag housing comprising:

a base for supporting an electronic tag;

a cover removably attachable to said base and defining therebetween an passageway for accommodating an elongate member;

said base including a deflectable latch for locking engagement with said cover, said base includes a series of spaced apart ribs extending from a top surface of said base, each of said series of ribs extend between opposing sidewalls, said opposing sidewalls includes at least one slot therethrough wherein said latch extending from said top surface of said base adjacent said at least one slot; and said cover including an access opening adjacent said latch for insertion of a removal tool thereinto to release said latch permitting detachment of said cover from said base.

9. An electronic tag housing of claim 8 wherein said base further includes a bottom panel attached to a bottom surface of said base and an upper panel covering said top surface of said base, said upper panel including an open top portion to allow said series of ribs to remain uncovered by said upper panel.

10. An electronic tag housing of claim 9 wherein said base supports an elastomeric pad for resilient engagement with said elongate member, said elastomeric pad molded to conform with said series of ribs.

11. An electronic tag housing of claim 10 wherein said cover having a semi-circular shape.

12. An electronic tag housing of claim 11 wherein said at least one slot of said base aligns with said access opening of said cover.

13. An electronic tag housing of claim 12 wherein said access opening includes a catch for releasebly engaging with said latch.

14. An assembly for removably securing an electronic tag to an elongate article comprising:

a housing including a base, a cover and a releasable member, said base attached to a cover defining therebetween a passageway for accommodating said elongate article therethrough, said base having a deflectable latch and said cover having a catch for releasably engaging said latch, said releasable member including a cover opening extending through said catch and a base slot adjacent said latch, said cover opening and said base slot are aligned when said base and cover are attached;

an electronic tag attached to said base; and a removal tool having a body and an insertion member, said insertion member being insertable into said cover opening and said base slot to engage said latch and deflect said latch from said catch to unattach said cover from said base.

15. A removable electronic tag housing comprising:

a base for supporting an electronic tag, said base includes opposing sidewalls extending from a top surface of said base and a series of spaced apart ribs extending from a top surface of said base, said series of ribs extend between said opposing sidewalls, said series of ribs define a half pipe geometry to support and elongated object thereon, said opposing sidewalls including slots therethrough, said base including deflectable latches extending from said top surface of said base opposed said slots, said base includes a bottom panel attached to a bottom surface of said base and an upper panel covering said upper surface of said base, said upper panel including an open top portion to allow said series of ribs to remain uncovered by said upper panel; and a cover removably attachable to said base defining an passageway for accommodating an elongate member therebetween, said cover having a semi circular shape and access openings extending on either side of said cover, said access openings including catches to engage with said latches of said base.

16. An electronic tag housing of claim 1 wherein said cover having a semi-circular shape.

17. An electronic tag housing of claim 1 wherein said base further includes a bottom panel attached to a bottom surface of said base.

18. An electronic tag housing of claim 1 wherein said passageway is defined by said sidewalls and said deflectable latch extend on either side of said passageway.

* * * * *